United States Patent [19]

Bunn et al.

[11] 4,383,810

[45] May 17, 1983

[54] FORMING CONCRETE SUPPORT CHAIRS

[76] Inventors: Norman W. Bunn, 1394 Chartwell Dr., West Vancouver; Christopher B. Bunn, 406-120 E. Keith Rd., North Vancouver, both of British Columbia, Canada

[21] Appl. No.: 225,687

[22] Filed: Jan. 16, 1981

Related U.S. Application Data

[63] Continuation of Ser. No. 24,161, Mar. 26, 1979, abandoned.

[51] Int. Cl.[3] ..... B28B 3/02; B28B 3/08

[52] U.S. Cl. ..... 425/122; 425/128; 425/344; 425/355

[58] Field of Search ..... 425/122, 128, 344, 355

[56] References Cited

U.S. PATENT DOCUMENTS 1,831,144 11/1931 Shearer ..... 425/122

2,675,581 4/1954 Payne ..... 425/344

3,060,506 10/1962 Uschmann ..... 425/344

3,906,624 9/1975 Ohta ..... 425/122 X

*Primary Examiner*—Thomas P. Pavelko

*Attorney, Agent, or Firm*—Fulwider, Patton, Rieber, Lee & Utecht

[57] ABSTRACT

The apparatus has a plurality of open-ended female dies with a movable lower male die positioned in the lower end of each one. A supply box is shiftable over the female dies to deposit concrete therein, following which a plurality of upper male dies are moved down into the female dies to compact the concrete therein into chairs. Wire supply means feeds wires through the upper male dies and into the concrete in the female dies before the concrete is compacted. After the wires have been cut above the female dies, the upper male dies are retracted and the lower male dies are moved upwardly to eject the compacted chairs from the female dies.

13 Claims, 7 Drawing Figures

FORMING CONCRETE SUPPORT CHAIRS

This is a continuation, of application Ser. No. 24,161, filed Mar. 26, 1979 now abandoned.

FIELD OF THE INVENTION

This invention relates to an apparatus for forming concrete support blocks or chairs.

Concrete support blocks, or chairs as they are usually called, are widely used in building, particularly as support for the reinforcing mesh or bar used in cast in situ concrete.

The present invention seeks to improve the method of producing these blocks and, in particular, to provide a compact apparatus able to produce the blocks. In a preferred embodiment the apparatus is able to produce blocks with tie wires projecting therefrom.

SUMMARY OF THE INVENTION

Accordingly the present invention is an apparatus for forming concrete building blocks comprising a supporting framework, a first platen mounted on the framework and carrying a plurality of open ended, female dies, an upper platen carrying a plurality of upper male dies aligned respectively with the female dies, the upper platen being reciprocable between a first, upper position in which it is remote from the first platen and a second position in which each upper male die is inserted a predetermined depth into the open, upper end of a corresponding female die, a lower platen fitted with a plurality of lower male dies, means to fix a first position of the lower platen so that each lower male die is inserted into the open, lower end of a corresponding female die by a predetermined amount, means to reciprocate the lower platen from the first position to a second position in which the upper surface of each lower male die is substantially flush with the upper end of the corresponding female die, and a supply box for concrete mix reciprocable on a pathway between a first position in which it can be filled with concrete and a second position over the first platen and the female dies thereof where it can fill the female dies with concrete.

In a preferred embodiment the apparatus includes tie wire supply means mounted on the upper platen, a plurality of openings in each male die through which the wire extends, a guide tube mounted on each male die for and in registry with each opening thereof and extending upwardly from the male die, said tie wires extending through the tubes, and feed means for moving the wires through their dies and into their respective female dies, and cutting means carried by the upper platen and positioned to cut said wires above the level of the female dies.

BRIEF DESCRIPTION OF THE DRAWINGS

An embodiment of the invention is illustrated in the drawings in which.

DESCRIPTION OF THE PREFERRED EMBODIMENTS

Figure 1:
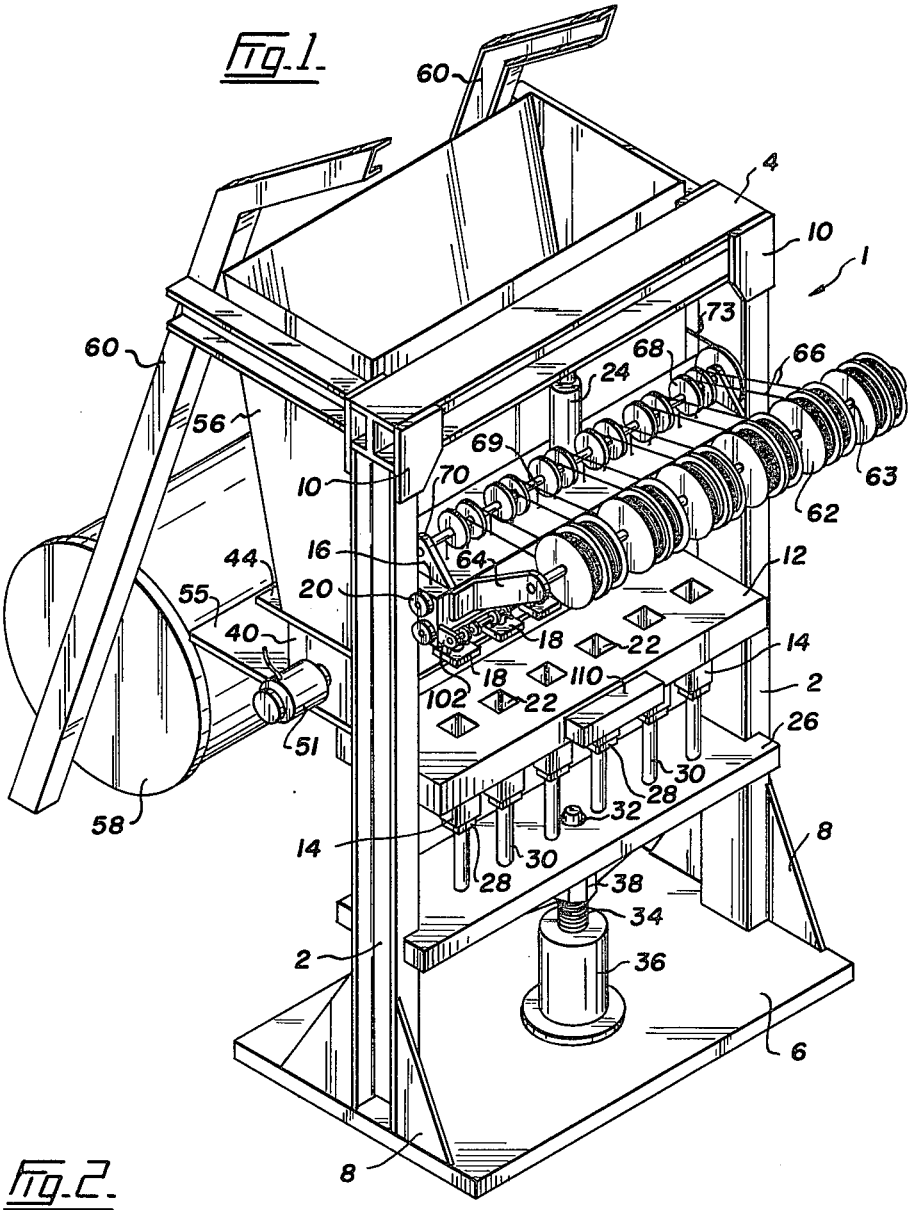
FIG. 1 is a perspective view of an apparatus according to a preferred embodiment of the invention.

The drawings illustrate an apparatus for forming concrete support blocks or chairs comprising a supporting framework 1 made up of spaced parallel uprights 2 and an upper cross member 4 joining the spaced uprights 2. The apparatus is formed with a base 6. The uprights 2 are secured to the base 6 and braced by gussets 8. At the upper corners of the frame the uprights 2 and the cross member 4 are braced at the joints by bracing members 10. The cross member 4 and base 6 firmly secure the uprights 2 together and maintain them rigidly in their parallel relationship.

A first or central platen 12 carrying a plurality of vertical and open ended female dies 14 is located between and fixedly secured to the uprights and is carried thereby. An upper platen 16 supporting a plurality of upper male dies 18, is positioned above the first platen 12 between the uprights 2. There is one die 18 for and in line with each of the dies 14 and is dimensioned to slidably fit therein. The upper platen 16 is provided with rollers 20 so that it can reciprocate between a first upper position, as illustrated in FIG. 1, in which it is remote from the central platen 12 and a second position in which each male die 18 is inserted a predetermined depth into the open upper end 22 of the female die 14 aligned therewith and corresponding thereto. The uprights 2 act as tracks for the rollers 20. The upper platen 16 has attached to it one end of a conventional, double acting hydraulic cylinder unit 24, the opposite end of which is connected to cross member 4, so that the platen can be reciprocated upwardly and downwardly in the frame between the first and second positions.

A lower platen 26 extends between and slidably fits on the tracks on uprights 2. This lower platen supports a plurality of lower male dies 28 by means of vertical columns 30. There is a die 28 aligned with and adapted to slidably fit in the lower end of each female die 14. The lower platen 26 has an opening 32 therein centrally thereof. A threaded column 34 extends through the clear opening 32 in the lower platen 26. The threaded column 34 is attached to one end of a double acting hydraulic cylinder unit 36 resting on base 6. Column 34 is provided with a nut 38. By turning the nut 38 the lower platen 26, and thus the male dies 28, can be adjusted upwardly or downwardly relative to the female dies. Nut 38 is turned before the machine is operated, so that the male dies 28 are each inserted into the open lower end of a corresponding female die 14 by a predetermined amount. Hydraulic cylinder 36 provides a means to reciprocate the lower platen 26 from the first position, set by the movement of the nut 38, to a second position in which the upper surface of each male die 28 is substantially flush with the upper end of its corresponding female die 14.

Figure 3:
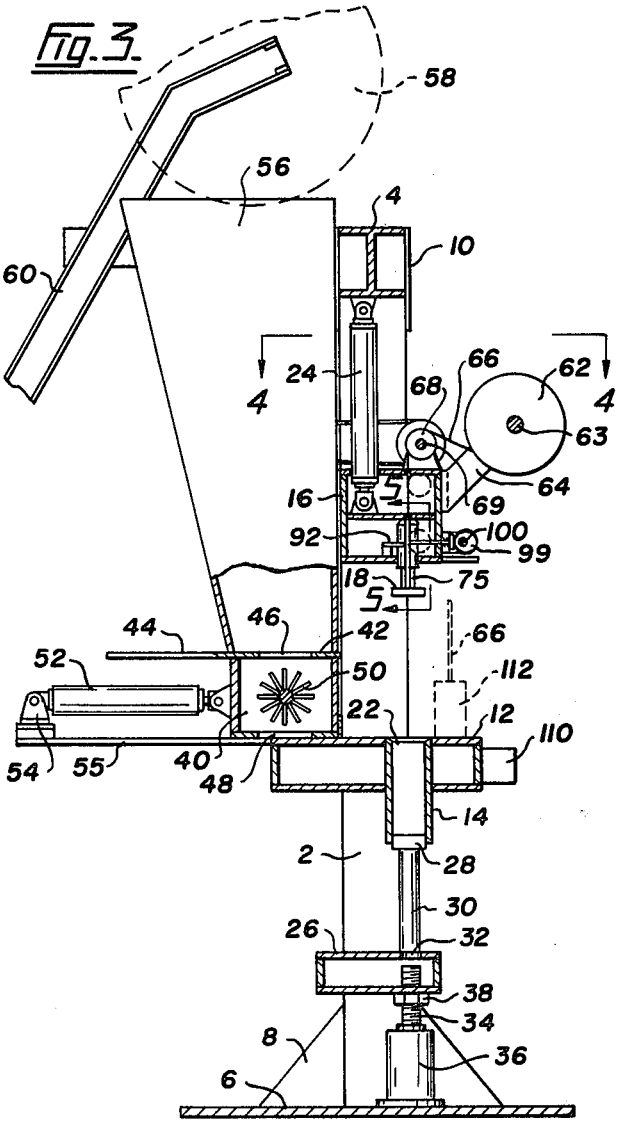
FIG. 3 is a vertical sectional view through the apparatus of FIG. 1.
Figure 7:
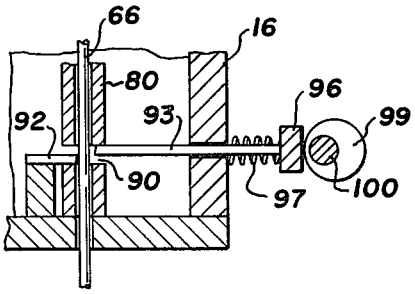
FIG. 7 is a cross section taken on the line 7—7 of FIG. 6.

The apparatus is provided with a supply box 40 for concrete mix as shown most clearly in FIG. 3, this box resting on central platen 12. Supply box 40 is reciprocable horizontally on platen 12 between the uprights 2 of the apparatus. Supply box 40 has a top 42 with an apron 44 extending from it in the direction away from the central platen. Top 42 is also provided with an inlet opening 46 for concrete, and there is an outlet opening 48 for concrete in the base of the supply box 40. This box 40 is provided with an agitator 50 therein and driven by a suitable motor, such as a hydraulic motor 51 mounted on the end of the box, as shown in FIG. 1, supplied by a pump, not shown. The agitator blends and keeps the concrete from compacting in the supply box 40.

A double acting hydraulic cylinder unit 52 anchored to a lug 54 is the means of reciprocating supply box 40 back and forth. Lug 54 is carried by support 55 projecting rearwardly from platen 12.

The illustrated embodiment includes a hopper 56 on box 40 over inlet 46 whereby concrete is fed into the supply box. Hopper 56 is supplied by a standard travelling mixer 58 that moves on tracks 60 from a first position—shown in FIG. 1—in which it can be filled, to a second position in which it is over the hopper 56 and able to direct its concrete into the hopper.

Figure 4:
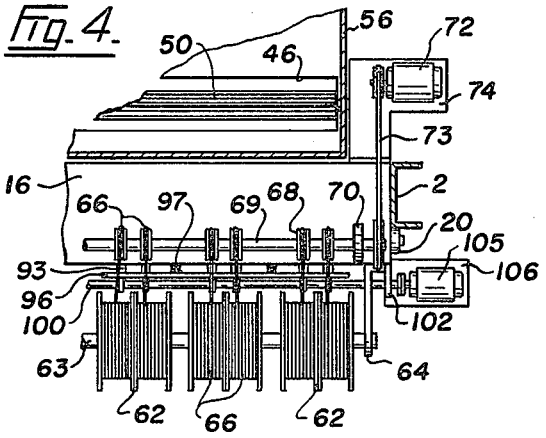
FIG. 4 is an enlarged sectional view taken on the line 4—4 of FIG. 3, showing the drive for tie wire feed means.

The illustrated preferred embodiment of the invention is provided with tie wire supply means for directing one or more wires to each male die 18. In this example, two wires are provided for each die. This wire supply means is in the form of wire spools 62 mounted for rotation on a shaft 63 which is carried by brackets 64 securing it to and extending outwardly from upper platen 16. Wires 66 from the spools 62 extend over feed rolls 68 fixedly mounted on a shaft 69 journalled in suitable bearings 70 carried by platen 16. This shaft is rotated in any suitable manner. In this example, the shaft is rotated by an electric motor 72 through a belt and pulley arrangement 73, said motor being supported by a bracket 74 secured to and projecting rearwardly from platen 16, see FIG. 4.

Each male die 18 comprises a stem 75 slidably mounted in a cylinder 76 carried by platen 16, said stem having an inner head 76 at its upper end in engagement with a spring 77 at the upper end of the cylinder. The amount of movement of head 76 under the action of spring 77 is limited by an annular stop 78 in the cylinder.

Figure 5:
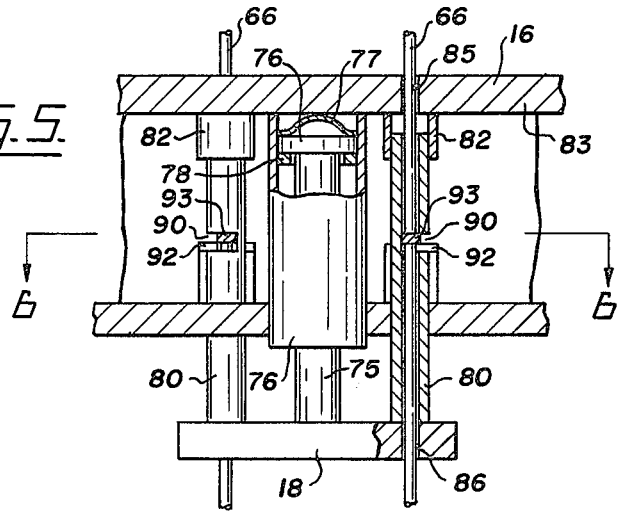
FIG. 5 is an enlarged view on the line 5—5 of FIG. 3 and showing wire cutting apparatus associated with a male die.

Each male die 18 has a tube 80 for each wire 66 associated therewith. Each tube 80 slidable extends into platen 16 and has an upper end slidably fitting in a sleeve 82 extending downwardly from the upper part 83 of the platen. The interior of each tube 80 is in registry with a hole 85 formed in part 83 of the platen, and another hole 86 formed in its die 18, see FIG. 5.

A wire 66 extends downwardly from each feed roll 68 into and through a die tube 80 therebeneath. When cylinder 24 is energized to move platen 16 and the dies 18 downwardly, and as the dies approach the female dies 14, the motor 72 is actuated to cause rollers 68 to feed the wires 66 downwardly through the male dies and into the female dies.

Figure 6:
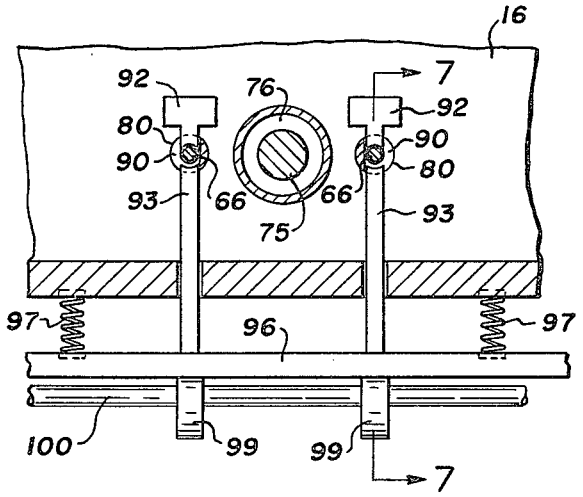
FIG. 6 is a horizontal section taken on the line 6—6 of FIG. 5.

The preferred embodiment of the invention includes cutting means for severing the wires 66 above the female dies after the wires have been moved downwardly therein a predetermined distance. In this example, each tube 80 has a transverse slot 90 therein into which a stationary cutter 92 and an opposed movable cutter 93 project. The inner edge of cutter 92 is located close to wire 66, while cutter 93 is normally spaced from said wire, see FIG. 6. All of the cutters 93 project forwardly to the front wall of platen 16 and are connected to a common bar 96. Springs 97 urge bar 96 outwardly relative to the platen and against cams 99 mounted on a shaft 100 which extends parallel to platen 16 and is journalled in suitable bearings 102 carrying by the platen. A motor 105 mounted on a bracket 106 carried the platen is drivingly connected to shaft 100 in any suitable manner.

When the wires 66 have been inserted the predetermined distance into female dies 14, motor 105 is energized to rotate cams 99 to move bar 96 towards the platen and thereby cause the cutters 92 and 93 to severe the wires in the male die tubes 80. The cams 99 make one revolution so that the cutters 93 are moved inwardly and outwardly relative to the tubes 80 during each operation. When cylinder 24 moves platen 16 and the male dies 18 back up to there inoperative positions, the wires 66 remain stationary at this time.

A standard high frequency vibrator 110 is mounted on the central platen 12 and is operable by its own motor to vibrate this platen and, consequently, the female dies 14.

The apparatus is provided with standard sequencing controls, but as these are available on the market, they have not been illustrated herein for the sake of clarity.

Figure 2:
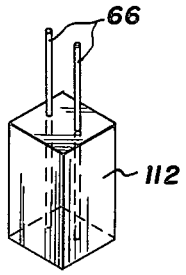
FIG. 2 is a view of a formed block made on the apparatus of the invention.

FIG. 2 illustrates a support block or chair 112 of the type made by the present apparatus, this block having two tie wires 66 therein. As these blocks are made in different heights, male dies 28 can be shifted to different starting positions in dies 14 for this purpose.

In operation the illustrated apparatus functions as follows. First, the lower platen 26 is moved upwardly by cylinder 26 so that the male dies 28 thereon enter the lower ends of the female dies 14 to form bottoms therefor. Concrete is directed into the hopper 56 by the travelling mixer 58. On pressing the start button, the hydraulic motor 51 on the supply box 40 is activated to turn the agitator 56. The box 40 is filled with concrete from the hopper 46 and is maintained in a fluid condition by the agitator 50. An automatic sequencing button is pressed. Cylinder 52 is energized to move the supply box 40 forwardly until its outlet 48 is aligned with the upper ends 22 of the female dies 14. Concrete enters the female dies and is prevented from passing from the lower end of these dies by the male dies 28 located therein. The apron 44 is aligned with the base of the hopper 56 so that when the supply box 40 is advanced to fill the female dies 14 concrete does not leave the hopper 56.

Box 40 is stopped for a predetermined time over the female dies 14, during which time the dies are filled. Cylinder 52 is now energized to return box 40 to its original position, as shown in FIG. 3. During the pouring of this concrete, or after, vibrator 110 is set into operation to impart vibrations to the concrete in the female dies.

This return of the supply box 40 to its original position activates a pressing cycle. The upper platen 16 is moved downwardly hydraulically under the influence of hydraulic cylinder 24. The male dies 18 on the upper platen enter the upper ends 22 of the female dies 14 and press the concrete contained in the dies. A pressure switch terminates the pressing cycle when the applied pressure from the male dies 18 reaches a certain level. At this stage the hydraulic cylinder 24 is operated to return the upper platen 16 and the male dies 18 to their original positions. Hydraulic pressure is applied to the cylinder 36 so that the male dies 28 on the lower platen 26 moves upwardly, forcing the concrete blocks or chairs 110 out of the female dies 14.

The forcing out of the chairs finishes the cycle. The automatic sequencing button must be pressed to initiate a new cycle. However, it is possible to have a more sophisticated system that removes the finished chairs automatically. This system incorporates a time delay to permit removal of the chairs from the female dies 14. The initial sequence of operation is then restarted automatically.

If the tie wires 66 are to be inserted into the concrete blocks or chairs, this is done as the dies 18 are moved towards and into dies 14. At this time, the wires are fed downwardly through the male dies sufficiently to move through the concrete in the female dies to a predetermined depth. The tubes 80 act as guides for the wires and prevent the wires from bending or buckling as they penetrate the concrete in the female dies as well, by virtue of the head 76 and spring 77 arrangement, and the arrangement of each of the tubes 88 slidably fitting into a sleeve 82, the holes 86 in the die 18 also act as guides for the wires 66 which are immediately adjacent the surface of the concrete and which permit the wires 66 to be fed into the concrete while preventing bending or buckling of them prior to the full force of the die 18 being pressed on the concrete by virtue of the inner head 76 engaging against the platen 16. After the male dies have pressed the concrete in the female dies, the cutters 93 are moved to severe the wires 66, after which cylinder 24 returns platen 16 and the male dies to their normal upper positions.

We claim:

1. Apparatus for forming concrete building blocks, comprising:

a supporting framework;

a stationary central platen mounted on the framework, a plurality of laterally spaced and vertical open-ended female dies carried by the central platen, an upper platen mounted on the framework for movement towards and away from the central platen between an upper position and a lower position;

a plurality of upper male dies carried by the upper platen and aligned respectively with the female dies, said male dies being respectively spaced above and inserted a predetermined depth in the female dies when the upper platen is in the upper position and lower position;

means to reciprocate the upper platen between the upper and lower positions thereof;

a lower platen monted on the framework for movement towards and away from the central platen between a lower position and an upper position, a plurality of lower male dies carried by the lower platen and aligned respectively with the female dies, means to fix the lower position of the lower platen so that each lower male die is positioned in the open lower end of a corresponding female die a predetermined amount, means to reciprocate the lower platen from the lower position to the upper position thereof in which the upper surface of each lower male die is substantially flush with the upper end of the corresponding female die, a supply box for concrete mix reciprocable on a pathway between a first position in which it can be filled with concrete mix and a second position over the central platen and the female dies thereof where it can fill the female dies with concrete mix, wire supply means mounted on the upper platen for movement therewith and for supplying at least one wire to each female die, a vertical opening through each upper male die and through which one of said wires extends, feed means on the upper platen for each of said wires, and power means on the upper platen operatively connected to said feed means and selectively operable to move each wire through its respective upper male die and into the concrete mix in the female die into which said respective male die moves.

2. An apparatus as claimed in claim 1, in which the supply box is provided with means to agitate the concrete.

3. An apparatus as claimed in claim 1 in which said framework comprises:

spaced uprights maintained rigidly in parallel relationship, said central platen extending between and being fixedly secured to the uprights, and said upper and lower platens respectively extending between and being slidable on the uprights.

4. An apparatus as claimed in claim 1, in which the lower platen is provided with a clear hole and mounted on a threaded column that projects through the clear hole, and an adjusting nut engaged on the column beneath the platen, whereby movement of the nut on the column defines the lower position for the lower platen.

5. An apparatus as claimed in claim 1 including a travelling mixer movable along a track from a first position, where it can be filled, to a second position where it can feed concrete to the hopper.

6. An apparatus as claimed in claim 1 in which the means to reciprocate the upper platen, the lower platen and the supply box are double acting hydraulic rams respectively operatively connected thereto.

7. An apparatus as claimed in claim 1 comprising elongate guide means on the upper platen aligned with and extending to said vertical opening of each upper male die and through which extends the wire extending through said vertical opening, said elongate guide means maintaining the wires relatively stiff as said wires enter the concrete mix in the female dies.

8. An apparatus as claimed in claim 7 wherein each of said upper male dies has an upwardly extending stem, and additionally comprising:

a first guide carried by said upper platen which allows each stem to slide between a first position abutting said upper platen and a second predetermined position away from contact with said upper platen; and resilient means connected between said upper platen and each stem, for urging the stem into the second position;

and wherein each of said elongate guide means comprises:

a second guide carried by said upper platen; and a tube registering with the respective vertical opening of its upper male die and slidably disposed in the second guide.

9. An apparatus as claimed in claim 7 in which each of said guide means comprises a tube registering with the respective vertical opening of its upper male die.

10. An apparatus as claimed in claim 9 in which each of said tubes has a transverse slot therein, and comprising:

a cutter projecting through each of said slots into the tube thereof on opposite sides of the wire extending through said tube, and operating means connected to the cutters operable to cause said cutters to sever the wire in the tube.

11. An apparatus as claimed in claim 1, including a hopper positioned over the first position of the supply box whereby concrete can be supplied to the supply box.

12. An apparatus as claimed in claim 5 comprising cutting means at each upper male die operable to sever said each wire of the upper die a predetermined distance above the aligned female die while said upper die is in said female die.

13. An apparatus as described in claim 1 or 6 wherein the means to fix the lower position of the lower platen can adjustably fix the lower position thereof.

* * * * *